US005927256A

United States Patent [19]

Morita et al.

[11] Patent Number: 5,927,256

[45] Date of Patent: Jul. 27, 1999

[54] FLOW CONTROL DEVICE OF AN ENGINE

[75] Inventors: Koji Morita, Susono; Takayuki Demura, Mishima, both of Japan

[73] Assignee: Toyota Jidosha Kabushiki Kaisha, Aichi-Ken, Japan

[21] Appl. No.: 08/893,302

[22] Filed: Jul. 15, 1997

[30] Foreign Application Priority Data

Jul. 16, 1996 [JP] Japan ..... 8-186233

[51] Int. Cl.[6] ..... F02M 25/07

[52] U.S. Cl. ..... 123/568.25

[58] Field of Search ..... 123/568.25, 568.29, 123/568.27, 389, 406.71; 137/907

[56] References Cited

U.S. PATENT DOCUMENTS 4,345,571 8/1982 Iizuka et al. ..... 123/568.27

FOREIGN PATENT DOCUMENTS 53-20016 2/1978 Japan .
61-53513 U 4/1986 Japan .
63-10255 U 1/1988 Japan .
7253057 10/1995 Japan .

*Primary Examiner*—Andrew M. Dollnar
*Assistant Examiner*—Arnold Castro
*Attorney, Agent, or Firm*—Kenyon & Kenyon

[57] ABSTRACT

A flow control device comprising an EGR control valve arranged in an EGR passage. The pressure control chamber of the EGR control valve is connected to a pressure control valve in a conduit, and a volume chamber is arranged in the conduit. The vibration of the valve body and the diaphragm of the EGR valve is prevented by the reflecting wave of the pressure wave which is produced in the pressure control chamber due to such vibrations.

13 Claims, 12 Drawing Sheets

FLOW CONTROL DEVICE OF AN ENGINE

BACKGROUND OF THE INVENTION

1. Field of the Invention

The present invention relates to a flow control device of an engine.

2. Description of the Related Art

Up until now, use has been made of an exhaust gas recirculation (EGR) device comprised of an EGR passage connecting the exhaust passage of an engine and the intake passage of an engine and an EGR control valve disposed in the EGR passage. In this EGR device, the amount of the EGR gas which is made to recirculate in the engine intake passage is controlled by the EGR control valve so that the EGR rate (amount of EGR gas/(amount of EGR gas+amount of intake air)) becomes the target EGR rate.

The pressure in the EGR passage, however, pulses due to the effect of the pulsation of the exhaust caused in the exhaust passage of the engine. If the pressure in the EGR passage pulsates in this way, the EGR rate will fluctuate causing the combustion to fluctuate as well.

Therefore, to suppress the pulsation of the pressure in the EGR passage, an EGR device which provides the EGR passage with an expanded chamber and throttling portion has been known (see Japanese Unexamined Utility Model Publication (Kokai) No. 63-10255).

On the other hand, the EGR control valve is usually comprised of a valve body disposed in the EGR passage, a diaphragm connected to the valve body, and a pressure control chamber defined by the diaphragm. By controlling the magnitude of the negative pressure in the pressure control chamber, the amount of the EGR gas is controlled. With this EGR control valve, when the pressure in the EGR passage pulsates, the valve body and the diaphragm will vibrate. The amplitude of the vibration of the valve body and the diaphragm becomes largest at a specific engine speed as will be explained later. If the valve body and the diaphragm vibrate strongly in this way, however, the durability of the EGR control valve will fall.

On the other hand, if the pulsation of the pressure in the EGR valve is suppressed such as in the above known EGR device, it is considered that it is possible to suppress even the vibration of the valve body and the diaphragm of the EGR control valve. The more one tries to suppress the pulsation of the pressure in the EGR passage, however, the harder it becomes for the EGR gas to flow, so the pulsation of the pressure in the EGR passage cannot be suppressed that much. Therefore, with the method of suppressing the pulsation of the pressure in the EGR passage as in the above known EGR device, therefore, there is the problem that it is not possible to sufficiently suppress the vibration of the valve body and the diaphragm of the EGR control valve.

SUMMARY OF THE INVENTION

An object of the present invention is to provide a flow control device capable of suppressing the generation of vibration of a movable member of a control valve.

According to the present invention, there is provided a flow control device of an engine having an exhaust passage, comprising a gas flow passage connected to the exhaust passage; a gas flow control valve having a valve body, a movable member connected to the valve body, and a pressure control chamber defined by the movable member; the valve body being arranged in the gas flow passage; a pressure control valve connected to the pressure control chamber via a fluid conduit for controlling an absolute pressure in the pressure control chamber to control an amount of displacement of the movable member, an amplitude of vibrations of the valve body and the movable member being increased due to vibration of an air column, which is generated in the gas flow passage when the engine is operating in a particular operating state determined by the engine; and vibration suppressing means arranged in the fluid conduit for suppressing the vibration of the movable member by using a reflecting wave of a pressure wave which has been generated in the pressure control chamber by the vibration of the movable member when the engine is operating in the particular operating state.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
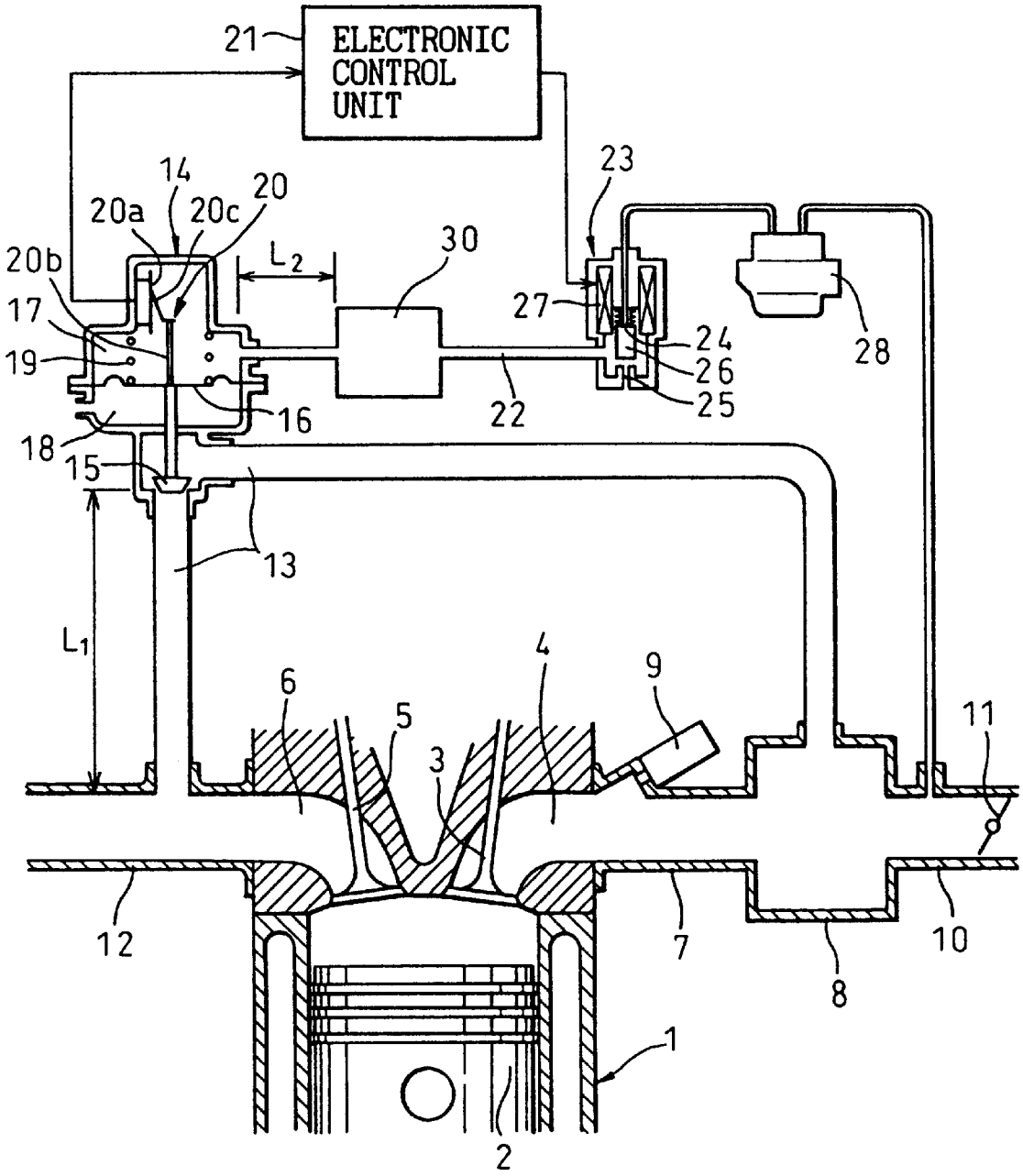
FIG. 1 is an overall view of an internal combustion engine.

FIG. 1 shows the case of application of the present invention to an EGR device.

Referring to FIG. 1, 1 is an engine body, 2 a piston, 3 an intake valve, 4 an intake port, 5 an exhaust valve, and 6 an exhaust port. The intake port 4 is connected through an intake tube 7 to a surge tank 8. Each intake tube 7 has a fuel injector 9 attached to it. The surge tank 8 is connected through an intake duct 10 and an air flow meter (not shown) to an air cleaner (not shown). In the intake duct 10 is arranged a throttle valve 11. On the other hand, the exhaust port 6 is connected to an exhaust manifold 12.

The exhaust manifold 12 and the surge tank 8 are connected to each other through a gas flow passage, that is, the EGR passage 13. In the EGR passage 13 is disposed a gas flow control valve, that is, the EGR control valve 14. The EGR control valve 14 is comprised of a valve body 15, a movable member connected to the valve body 15, for example, a diaphragm 16, a pressure control chamber 17 defined by the diaphragm 16, an atmospheric pressure chamber 18, a compression spring 19 for biasing the diaphragm 16 to the atmospheric pressure chamber 18 side, and a lift sensor 20 for the valve body 15. The lift sensor 20 is comprised of a stationary variable resistor 20*a*, a shaft 20*b* connected to the diaphragm 16, and a brush 20*c* supported by the shaft 20*b* and sliding on the variable resistor 20*a*. The lift sensor 20 generates an output voltage proportional to the amount of lift of the valve body 15. This output voltage is input to an electronic control unit 21.

The pressure control chamber 17 of the EGR control valve 14 is connected through a conduit 22 to a pressure control valve 23. The pressure control valve 23 is provided with a mutually facing negative pressure port 24 and atmospheric pressure port 25, a valve body 26 arranged between the same, and a solenoid 27 for controlling the attraction of the valve body 26. The negative pressure port 24 is connected through a pressure adjustment valve 28 to the inside of the intake duct 10 downstream of the throttle valve 11. When the valve body 26 closes the atmospheric pressure port 25, a predetermined negative pressure controlled by the pressure adjustment valve 28 is applied to the inside of the conduit 22, while when the valve body 26 closes the negative pressure port 24, the atmospheric pressure is applied to the inside of the conduit 22. In practice, the time when the valve body 26 closes the atmospheric pressure port 25 and the time when the valve body 26 closes the negative pressure port 24 are controlled by a duty ratio based on the output signal of the electronic control unit 21. An absolute pressure according to this duty ratio is therefore generated in the pressure control chamber 17.

As shown in FIG. 1, a volume chamber 30 of a predetermined volume is formed in the conduit 22. The length of the conduit 22 between the EGR control valve 14 and the volume chamber 30 is made L2. On the other hand, the EGR passage 13 between the valve body 15 of the EGR control valve 14 and the exhaust manifold 12 has the length L1.

Figure 2:
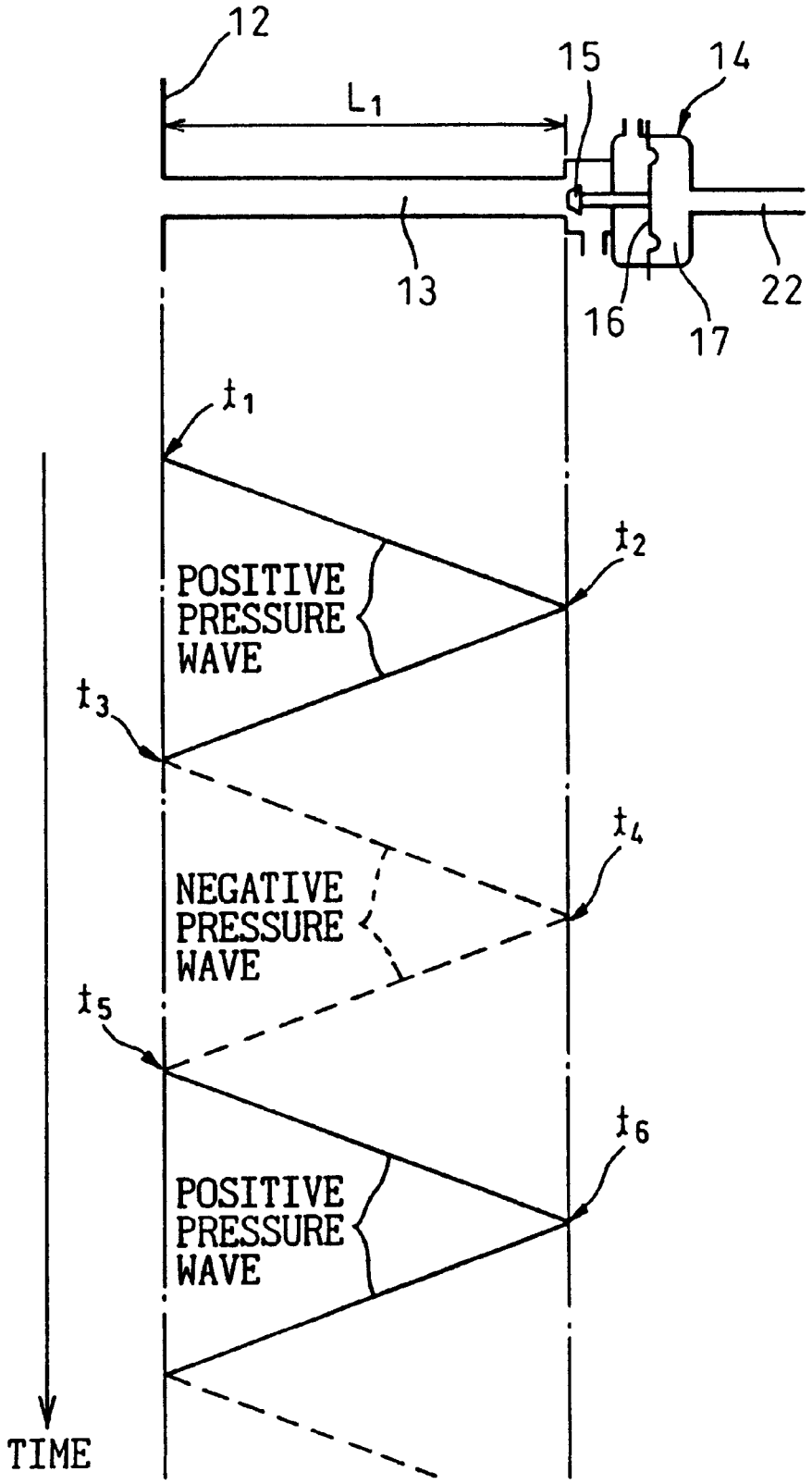
FIG. 2 is a view for explaining the vibration of a column of air.

Next, an explanation will be given of the vibration of the air column caused in the EGR passage 13 of the length L1 referring to FIG. 2 Note that in FIG. 2, the solid line shows the state of the propagation of the positive pressure wave along with the elapse of time, while the broken line shows the state of the negative pressure wave along with the elapse of time.

Due to the action of the exhaust of the exhaust gas from the cylinders, exhaust pulsation occurs in the exhaust manifold 12. This exhaust pulsation causes pulsation in the EGR passage 13 as well. That is, suppose now that the pressure in the exhaust manifold 12 becomes instantaneously higher due to action of exhaust of the exhaust gas from a certain cylinder and that as a result a positive pressure wave is created at the inlet opening of the EGR passage 13 at the time t1 in FIG. 2. If a positive pressure wave occurs at the inlet opening of the EGR passage 13, the positive pressure wave will propagate through the EGR passage 13 toward the valve body 15 and then reach the valve body 15. This time is shown by the time t2 in FIG. 2. When the positive pressure wave reaches the valve body 15, the valve body 15 and the diaphragm 16 are made to displace to the right direction in FIG. 2.

On the other hand, when the positive pressure wave reaches the valve body 15, the positive pressure wave reflects back at the valve body 15, then propagates toward the exhaust manifold 12 and then again reaches the inlet opening of the EGR passage 13. This time is shown by the time t3 in FIG. 2. If the positive pressure wave reaches the open end such as the inlet opening of the EGR passage 13, the positive pressure wave will reflect back as a negative pressure wave and this negative pressure wave will propagate toward the valve body 15. Next, this negative pressure wave will reach the valve body 15 at the time t4 and then reflect back at the valve body 15 and once again head toward the exhaust manifold. Next, this negative pressure wave will reach the inlet opening of the EGR passage 13 and then the negative pressure wave will reflect back as a positive pressure wave and reach the valve body 15 at the time t6. This will then be repeated.

As shown by the time t5, however, if each time the positive pressure wave reflects back at the inlet opening of the EGR passage 13, the pressure in the exhaust manifold 12 instantaneously becomes higher due to the action of exhaust of the exhaust gas from one of the cylinders, the positive pressure wave reflected at the inlet opening of the EGR passage 13 will be strengthened and as a result air column vibration will occur in the EGR passage 13 between the exhaust manifold 12 and the valve body 15. If such air column vibration occurs, a strong positive pressure wave will act on the valve body 15 at predetermined periods, so the valve body 15 and the diaphragm 16 will violently vibrate.

Figure 3:
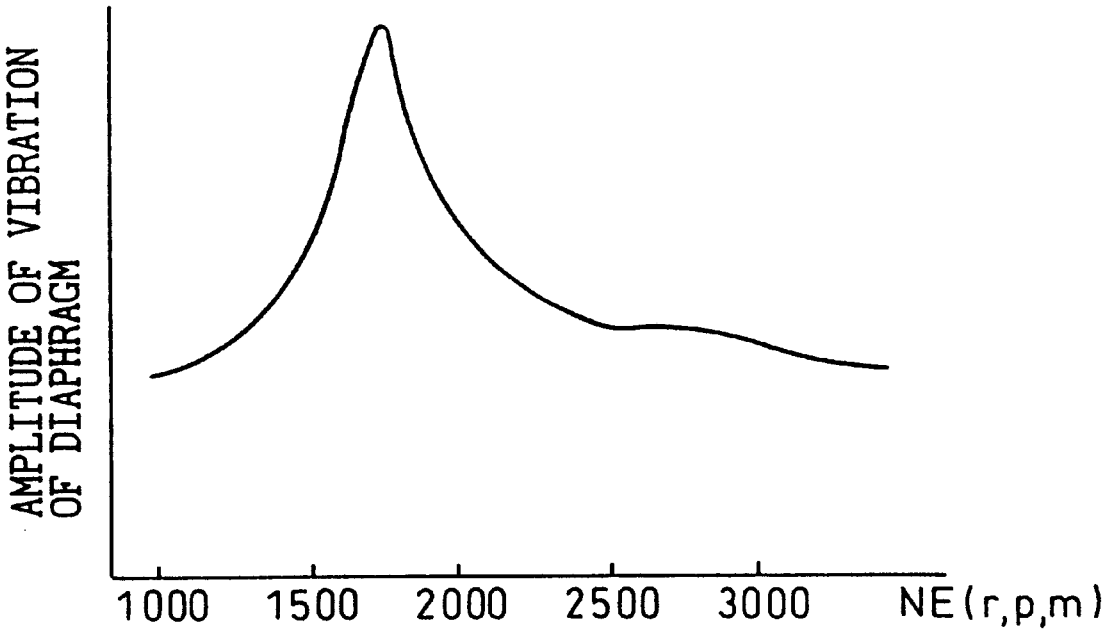
FIG. 3 is a view of the amplitude of vibration of a diaphragm.

FIG. 3 shows the relationship between the vibration and amplitude of the diaphragm 16 and the engine speed NE. In the embodiment shown in FIG. 1, when the engine speed NE was close to about 1750 rpm, the period of reflectance of the positive pressure wave at the inlet opening of the EGR passage 13 and the period of exhaust of exhaust gas from one of the cylinders was the same and therefore in the embodiment shown in FIG. 1, the amplitude of the vibration of the diaphragm 16 became the greatest near an engine speed NE of about 1750 rpm. Note that the engine speed NE at which the amplitude of the diaphragm 16 becomes greatest changes depending on the length L1 of the EGR passage 13 and the number of cylinders, so the engine speed NE at which the amplitude of the diaphragm 16 becomes the greatest differs according to the type of the engine.

If the amplitude of the vibration of the valve body 15 and the diaphragm 16 becomes larger in this way, however, first, there is the problem that the durability of the EGR control valve 14 will drop. Second, if, as shown in FIG. 1, the EGR control valve 14 is provided with a lift sensor 20, the problem will occur of the variable resistor 20*a* and the brush 20*c* quickly being worn down. To solve these problems, it is sufficient to prevent the amplitude of the vibration of the diaphragm 16 from becoming too large. Therefore, in the embodiment shown in FIG. 1, the volume chamber 30 is provided in the conduit 22.

If such a volume chamber 30 is provided in the conduit 22, it is possible to prevent the amplitude of the vibration of the diaphragm 16 from becoming too large. Next, an explanation will be made of the action of suppression of vibration of the diaphragm 16 while referring to FIG. 4 for the case where the length L1 of the EGR passage 13 between the exhaust manifold 12 and the valve body 15 is made equal to the length L2 of the conduit 22 between the EGR control valve 14 and the volume chamber 30.

As explained before, if the positive pressure wave propagated in the EGR passage 13 reaches the valve body 15 (time t2 in FIG. 4), the valve body 15 and the diaphragm 16 will be made to displace to the right direction in FIG. 4. If the diaphragm 16 is made to displace to the right direction, a positive pressure wave will be generated in the pressure control chamber 17 (time t2' in FIG. 4) and will be propagated through the conduit 22 toward the volume chamber 30.

Next, when this positive pressure wave reaches the open end of the conduit 22 leading to the volume chamber 30 (time t3' in FIG. 4), it will reflect back as a negative pressure wave and propagate through the conduit 22 toward the pressure control chamber 17. Next, this negative pressure wave will reach the pressure control chamber 17 (time t4' in FIG. 4). The volume of the pressure control chamber 17 of the EGR control valve 14 is in actuality considerably smaller than the volume of the volume chamber 30 so at the time t4' of FIG. 4, the negative pressure wave reaching the pressure control chamber 17 will reflect back as it is in the form of a negative pressure wave.

Figure 4:
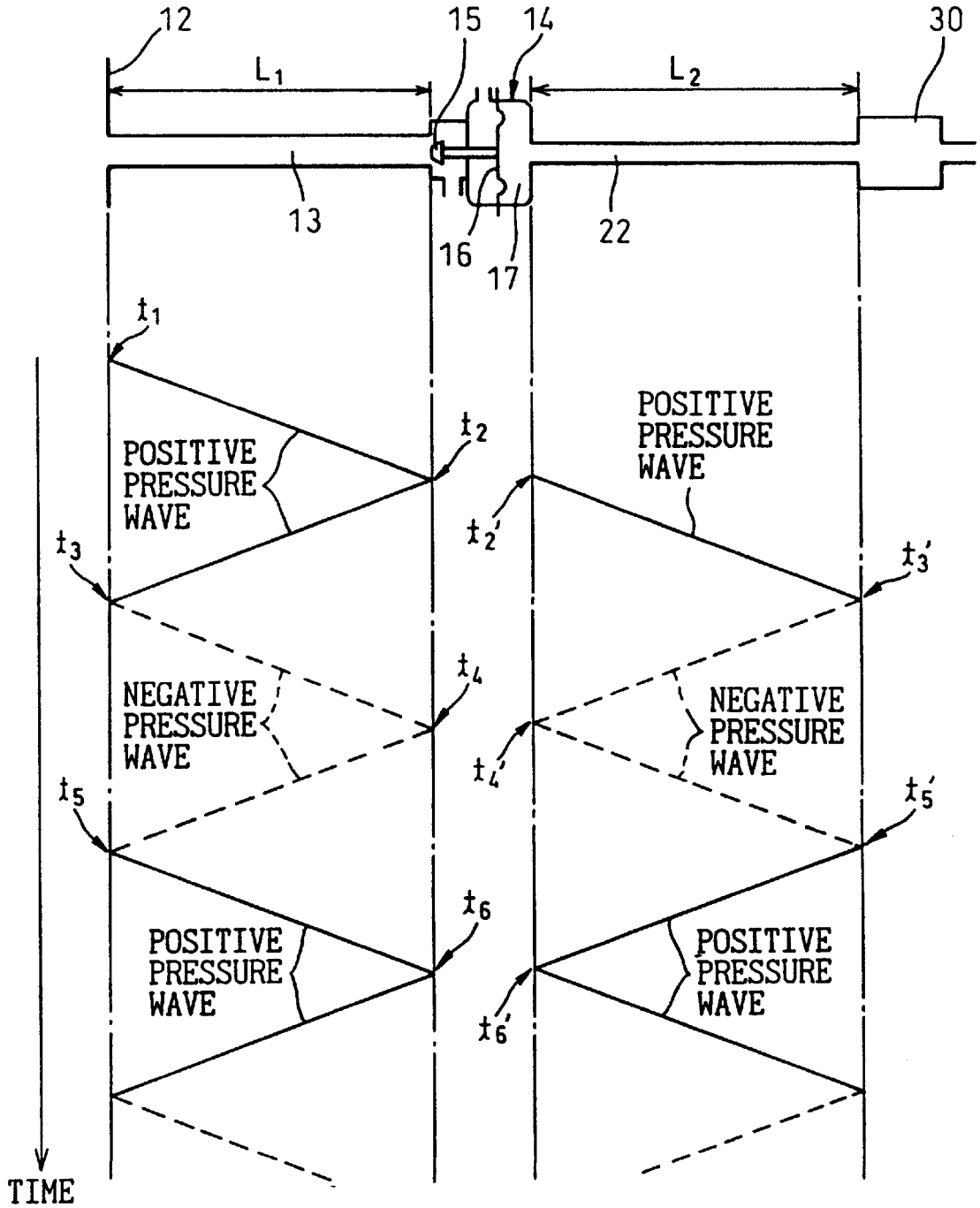
FIG. 4 is a view of the state of the propagation of a positive pressure wave and a negative pressure wave.

Next, this negative pressure wave will reach the volume chamber 30 at the time t5' of FIG. 4 then will reflect back in the form of a positive pressure wave which will reach the pressure control chamber 17 at the time t6' of FIG. 4. That is, when the positive pressure wave which propagated through the EGR passage 13 reaches the valve body 15 (time t6 of FIG. 4), the positive pressure wave which propagated through the conduit 22 will reach the pressure control chamber 17 (time t6 of FIG. 4). Accordingly, the force for making the diaphragm 16 displace in the right direction and the force for making the diaphragm 16 displace in the left direction will cancel each other out, so the diaphragm 16 will no longer displace that much and therefore even when air column vibration occurs in the EGR passage 13, it will be possible to prevent; the amplitude of the vibration of the valve body 15 and the diaphragm 16 from becoming too great.

Figure 5:
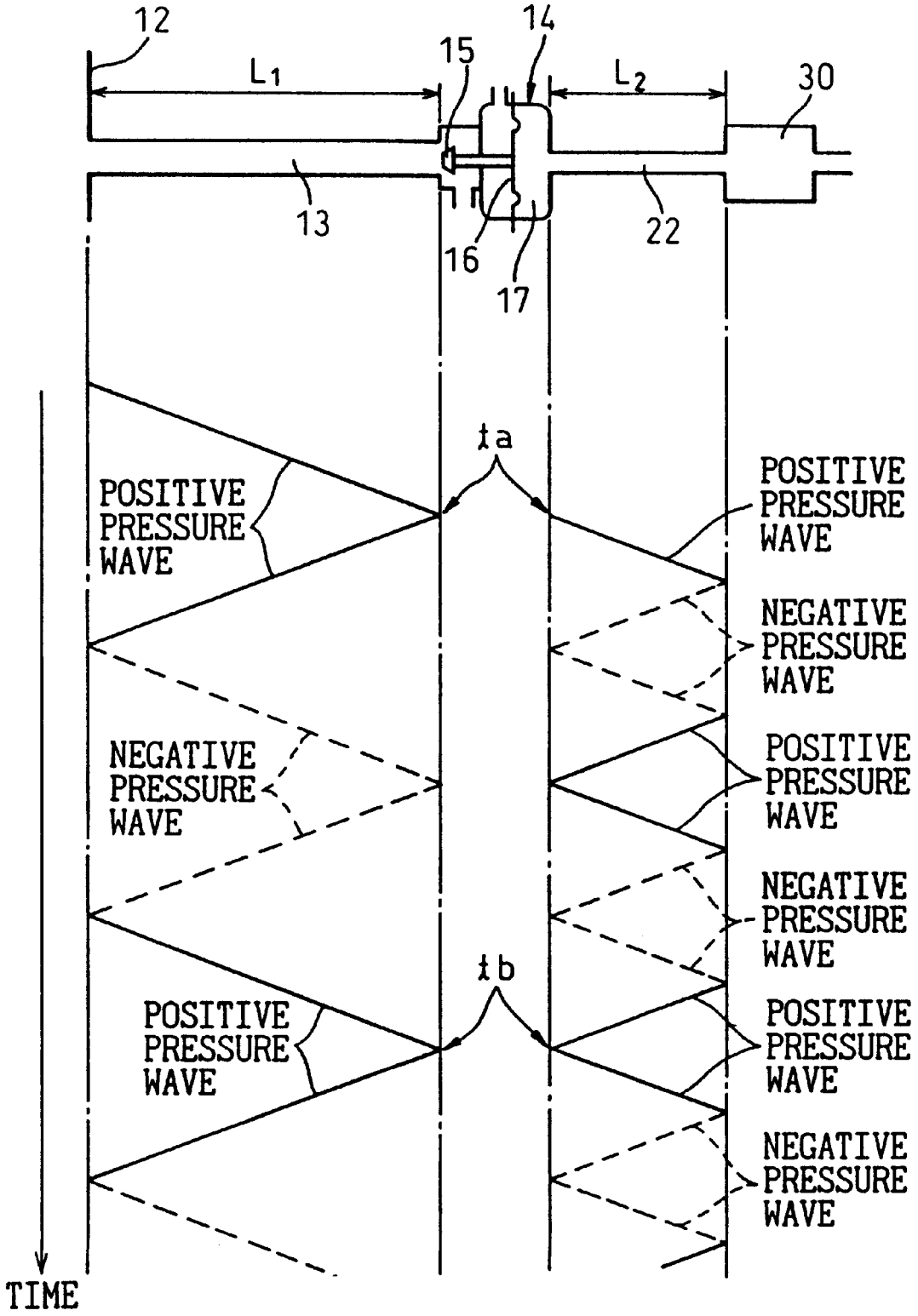
FIG. 5 is a view of the state of the propagation of a positive pressure wave and a negative pressure wave.

FIG. 5 shows the case where the length L2 of the conduit 22 between the EGR control valve 14 and the volume chamber 30 is made ½ of the length L1 of the EGR passage 13 between the exhaust manifold 12 and the valve body 15. In this case as well, if a positive pressure wave is generated in the pressure control chamber 17 at the time ta due to the positive pressure wave generated in the EGR passage 13, the positive pressure wave propagated in the conduit 22 will reach the pressure control chamber 17 at the time tb when the positive pressure wave propagated through the EGR passage 13 reaches the valve body 15. Accordingly, even when air column vibration is caused in the EGR passage 13, the amplitude of the vibration of the diaphragm 16 can be prevented from becoming too large.

Further, even when the length L2 of the conduit 22 between the EGR control valve 14 and the volume chamber 30 is made ¼ of the length L1 of the EGR passage 13 between the exhaust manifold 12 and the valve body 15, the positive pressure wave propagated in the conduit 22 will reach the pressure control chamber 17 at the time when the positive pressure wave propagated through the EGR passage 13 reaches the valve body 15. Accordingly, even when air column vibration is caused in the EGR passage 13, the amplitude of the vibration of the diaphragm 16 can be prevented from becoming too large. Note that FIG. 1 shows this case.

Figure 6:
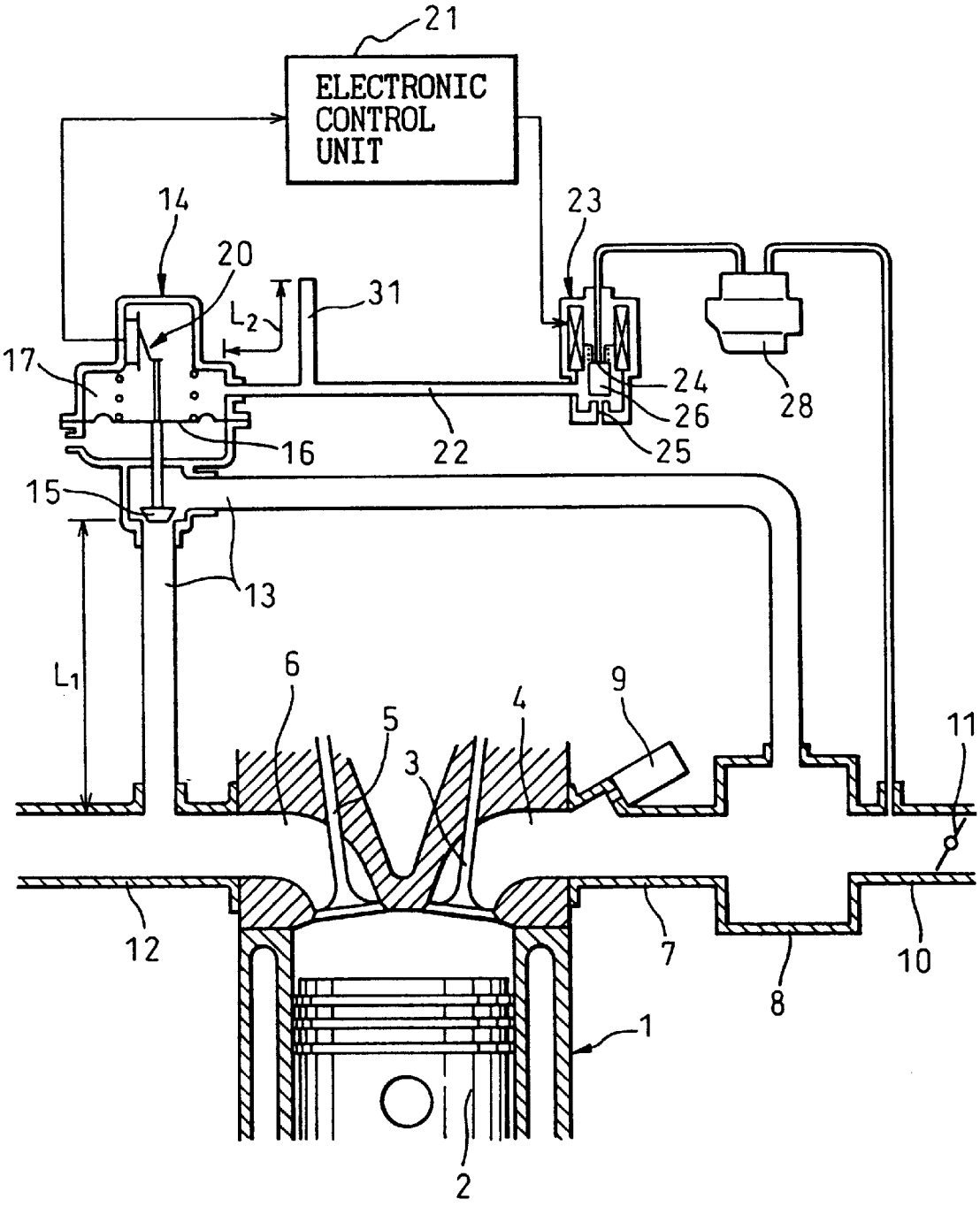
FIG. 6 is an overall view of an internal combustion engine showing another embodiment.
Figure 7:
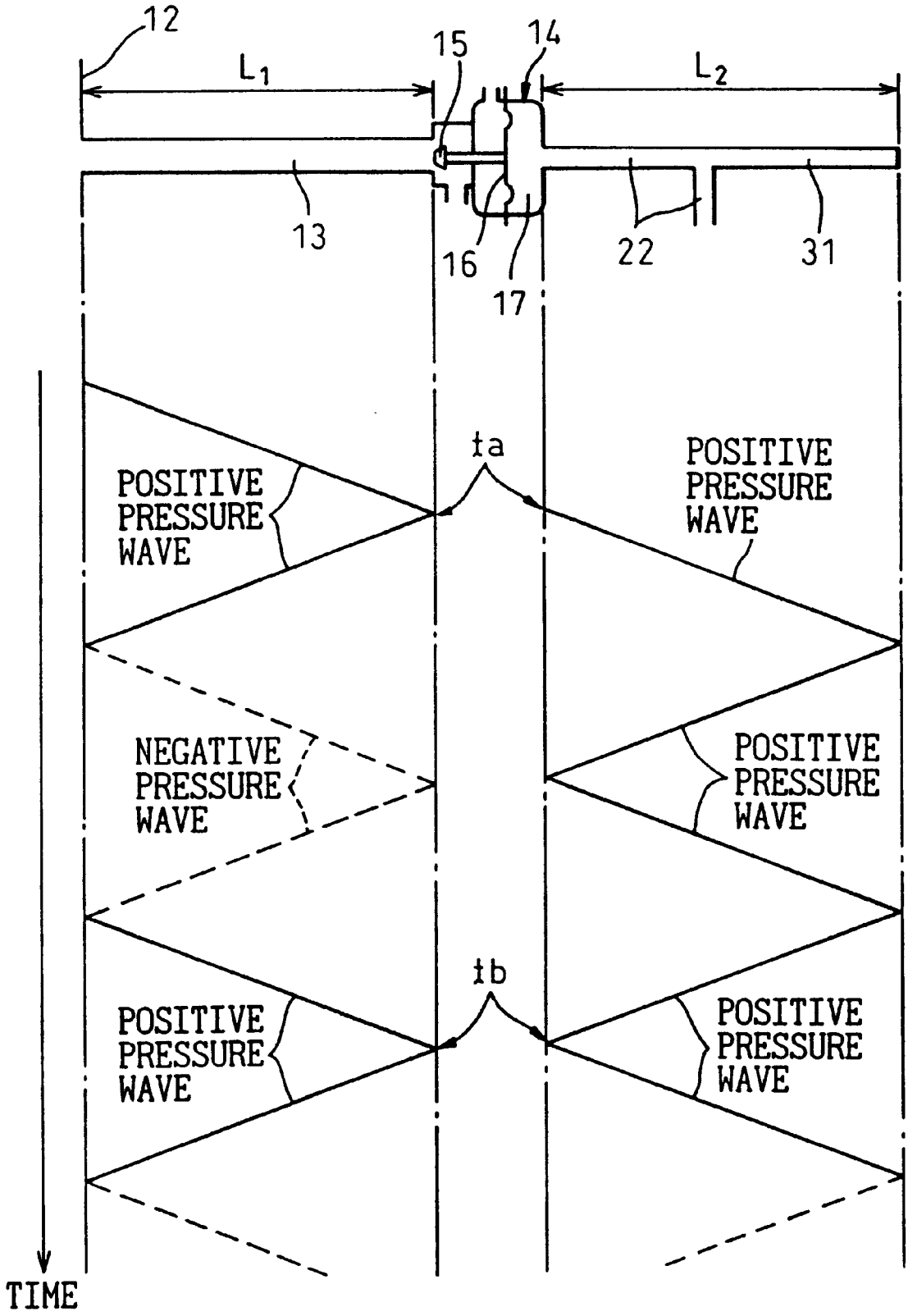
FIG. 7 is a view of the state of the propagation of a positive pressure wave and a negative pressure wave.

FIG. 6 shows another embodiment of FIG. 1. In this embodiment, a tube 31 with a closed end is connected to the conduit 22 for suppressing the vibration of the diaphragm 16. The state of the propagation of the positive pressure wave and the negative pressure wave in the case where such a tube 31 is connected to the conduit 22 is shown in FIG. 7. Note that FIG. 7 shows the case where the length L1 of the EGR passage 13 between the exhaust manifold 12 and the valve body 15 is equal to the length L2 between the EGR control valve 14 and the closed end of the tube 31.

As will be understood from FIG. 7, the positive pressure wave generated in the pressure control chamber 17 propagates through the conduit 22 and then the tube 31 to reach the closed end of the tube 31. At the closed end of the tube 31, it reflects back in the form of a positive pressure wave. Next, this positive pressure wave propagates through the tube 31 and the conduit 22 and reaches the pressure control chamber 17 again. In this embodiment as well, if a positive pressure wave is generated in the pressure control chamber 17 at the time ta due to the positive pressure wave generated in the EGR control valve 13, the positive pressure wave propagated through the conduit 22 will reach the pressure control chamber 17 at the time tb when the positive pressure wave propagated through the EGR passage 13 reaches the valve body 15. Accordingly, even if an air column vibration occurs in the EGR passage 13, the amplitude of the vibration of the diaphragm 16 can be prevented from becoming too large.

As will be understood from FIG. 7, in this embodiment, even when the length L2 between the EGR control valve 14 and the closed end of the tube 31 is made twice that of the length L1 of the EGR passage 13 between the exhaust manifold 12 and the valve body 15, the positive pressure wave propagated through the conduit 22 will reach the pressure control chamber 17 at the time when the positive pressure wave propagated through the EGR passage 13 reaches the valve body 15 and, even when the length L2 between the EGR control valve 14 and the closed end of the tube 31 is made ½ that of the length L1 of the EGR passage 13 between the exhaust manifold 12 and the valve body 15, the positive pressure wave propagated through the conduit 22 will reach the pressure control chamber 17 at the time when the positive pressure wave propagated through the EGR passage 13 reaches the valve body 15. Accordingly, in each case, when an air column vibration occurs in the EGR passage 13, the amplitude of the vibration of the diaphragm 16 can be prevented from becoming too large.

Note that in this embodiment, the positive pressure wave generated in the pressure control chamber 17 also will reach the pressure control valve 23 and reflect back at the pressure control valve 23. However, the valve body 26 of the pressure control valve 23 alternately closes and opens the negative pressure port 24 and the atmospheric pressure port 25, so the pressure control valve 23 does not function as a closed end or function as an open end. Accordingly, the wave reflected at the pressure control valve 23 is weak and it is difficult to use the reflected wave to suppress the vibration of the diaphragm 16.

Figure 8:
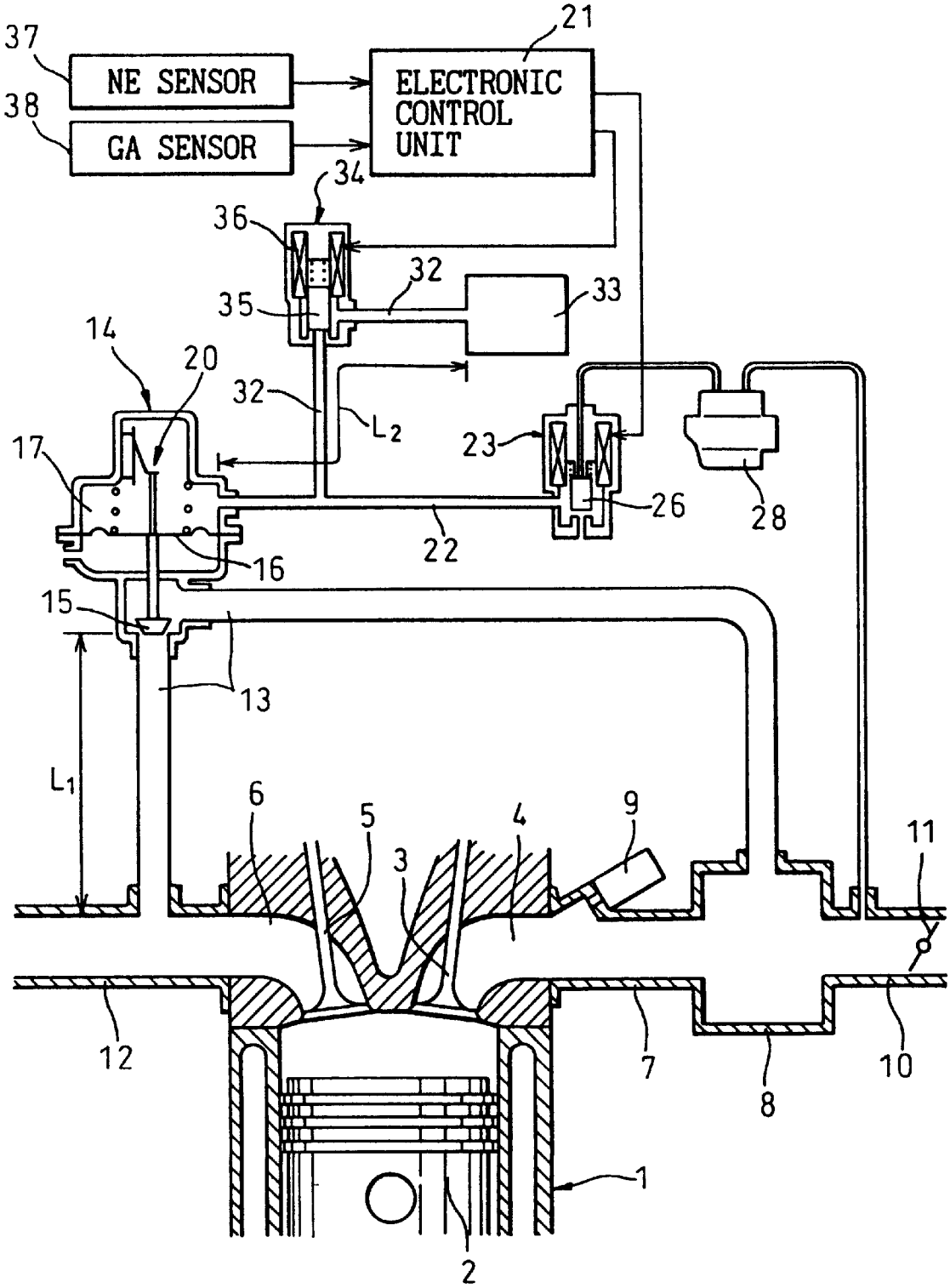
FIG. 8 is an overall view of an internal combustion engine showing still another embodiment.

FIG. 8 shows still another embodiment. As explained above, in an internal combustion engine provided with an EGR device as shown in FIG. 1, the amplitude of the vibration of the diaphragm 16 becomes extremely large at a specific engine speed as shown in FIG. 3. Therefore, in the embodiment shown in FIG. 8, the vibration of the diaphragm 16 is made to be suppressed just at the time of this specific engine speed. Therefore, in this embodiment, a tube 32 is branched off from the conduit 22, a volume chamber 33 is connected to the front end of the tube 32, and a switching valve 34 is disposed in the tube 32. This switching valve 34 is comprised of a valve body 35 for controlling the opening and closing of the flow path of the tube 32 and a solenoid 36 for controlling the attraction of the valve body 35. The solenoid 36 is controlled by an output signal of the electronic control unit 21. Note that the electronic control unit 21 receives as input the output signal of an engine speed sensor 37 and the output signal of an intake air sensor 38.

In this embodiment, the length L2 of the conduit 22 and tube 33 between the EGR control valve 14 and the volume chamber 33 is formed to be equal to the length L1 of the EGR passage 13 between the exhaust manifold 12 and the valve body 15. The switching valve 34 is usually closed. When the specific engine speed where the amplitude of the vibration of the diaphragm 16 becomes larger is reached, the switching valve 34 is opened. When the switching valve 34 is opened, a positive pressure wave and a negative pressure wave are propagated at the same timing as the timing shown in FIG. 4 and therefore the amplitude of the vibration of the diaphragm 16 can be prevented from becoming too large.

If a volume chamber 30 is provided in the conduit 22 as shown in FIG. 1, a delay in response will occur in the control of the pressure of the pressure control chamber 17 of the EGR control valve 14 with respect to the pressure control action by the pressure control valve 23. However, in the embodiment shown in FIG. 8, the chamber is not provided in the conduit 22, so there is the advantage that the response of the pressure control of the pressure control chamber 17 with respect to the pressure control action of the pressure control valve 23 becomes excellent.

Figure 9:
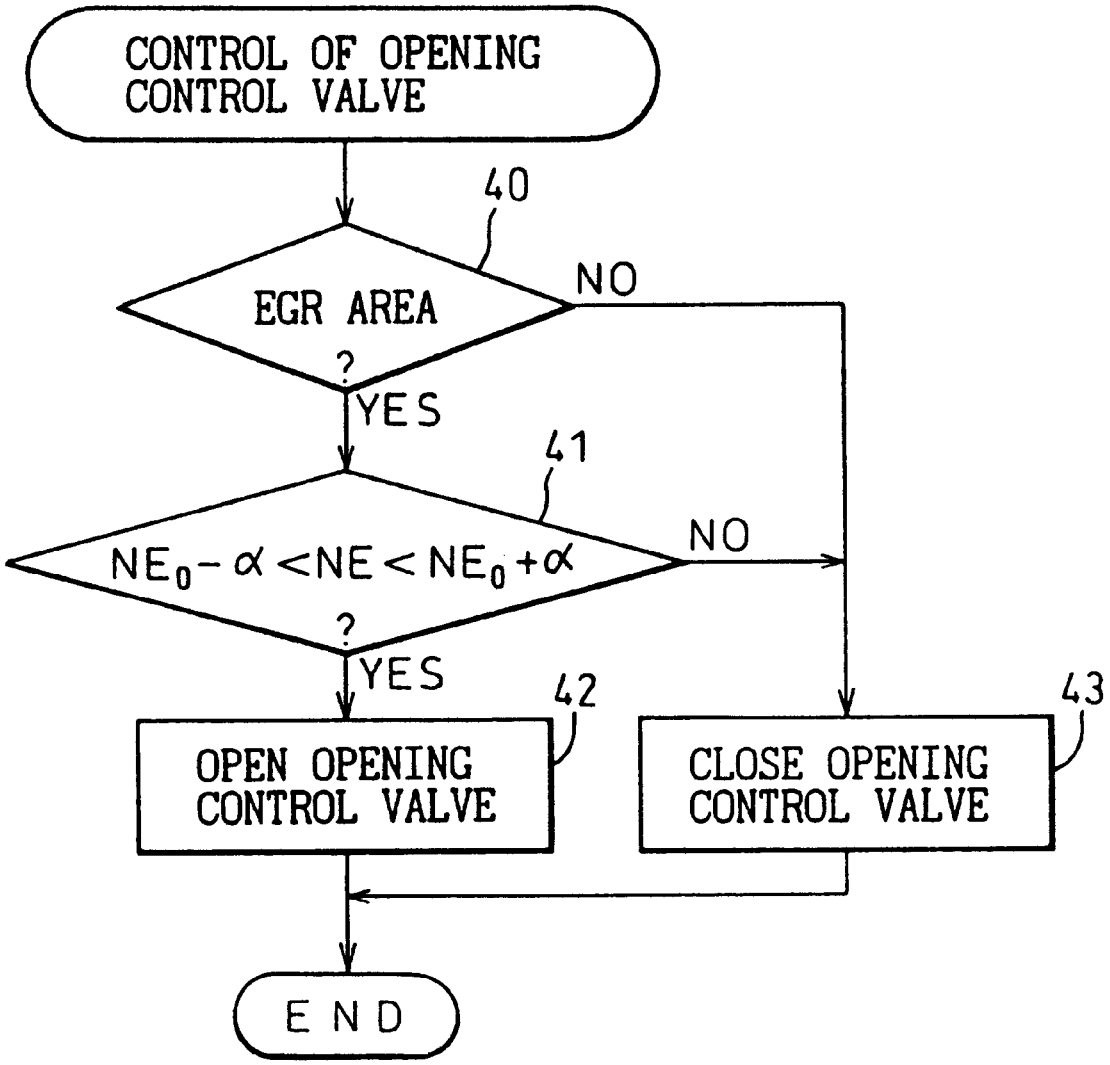
FIG. 9 is a flow chart for the control of a switching valve.

FIG. 9 shows the control routine for the switching valve 34. This routine is executed by interruption at predetermined time intervals.

Referring to FIG. 9, first, at step 40, it is judged based on the engine speed NE and the intake air amount GA if the engine operating state is in the EGR region for recirculation of the EGR gas. If not the EGR region, the routine proceeds to step 43, where the switching valve 34 is closed. As opposed to this, if in the EGR region, the routine proceeds to step 41, where it is judged if the current engine speed NE is in the range of $NE0-\alpha<NE<NE0+\alpha$ (where $\alpha$ is a constant) with respect to the engine speed NE0 where the amplitude of the vibration of the diaphragm 16 becomes the greatest. When $NE\leqq NE0-\alpha$ or $NE\geqq NE0+\alpha$, the routine proceeds to step 43, where the switching valve 34 is closed. As opposed to this, when $NE0-\alpha<NE<NE0+\alpha$, the routine proceeds to step 42, where the switching valve 34 is opened.

Figure 10:
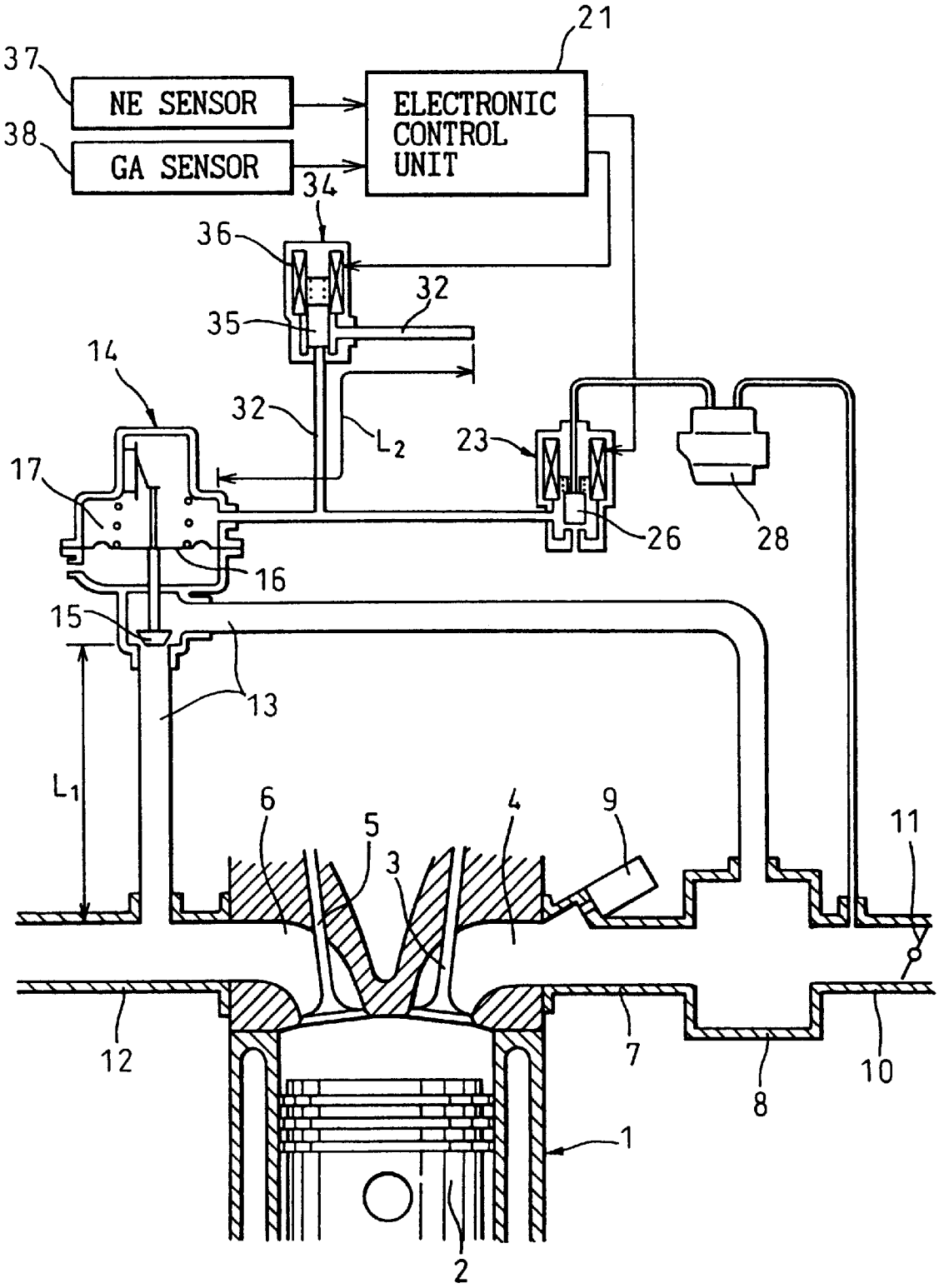
FIG. 10 is an overall view of an internal combustion engine showing still another embodiment.

FIG. 10 shows a modification of the embodiment shown in FIG. 8. In this embodiment, the front end of the tube 32 is closed and the length L2 from the EGR control valve 14 to the closed end of the tube 32 is made equal to the length L1 of the EGR passage 13 between the exhaust manifold 12 and the valve body 15. In this embodiment as well, the switching valve 34 is controlled by the control routine shown in FIG. 9.

Figure 11:
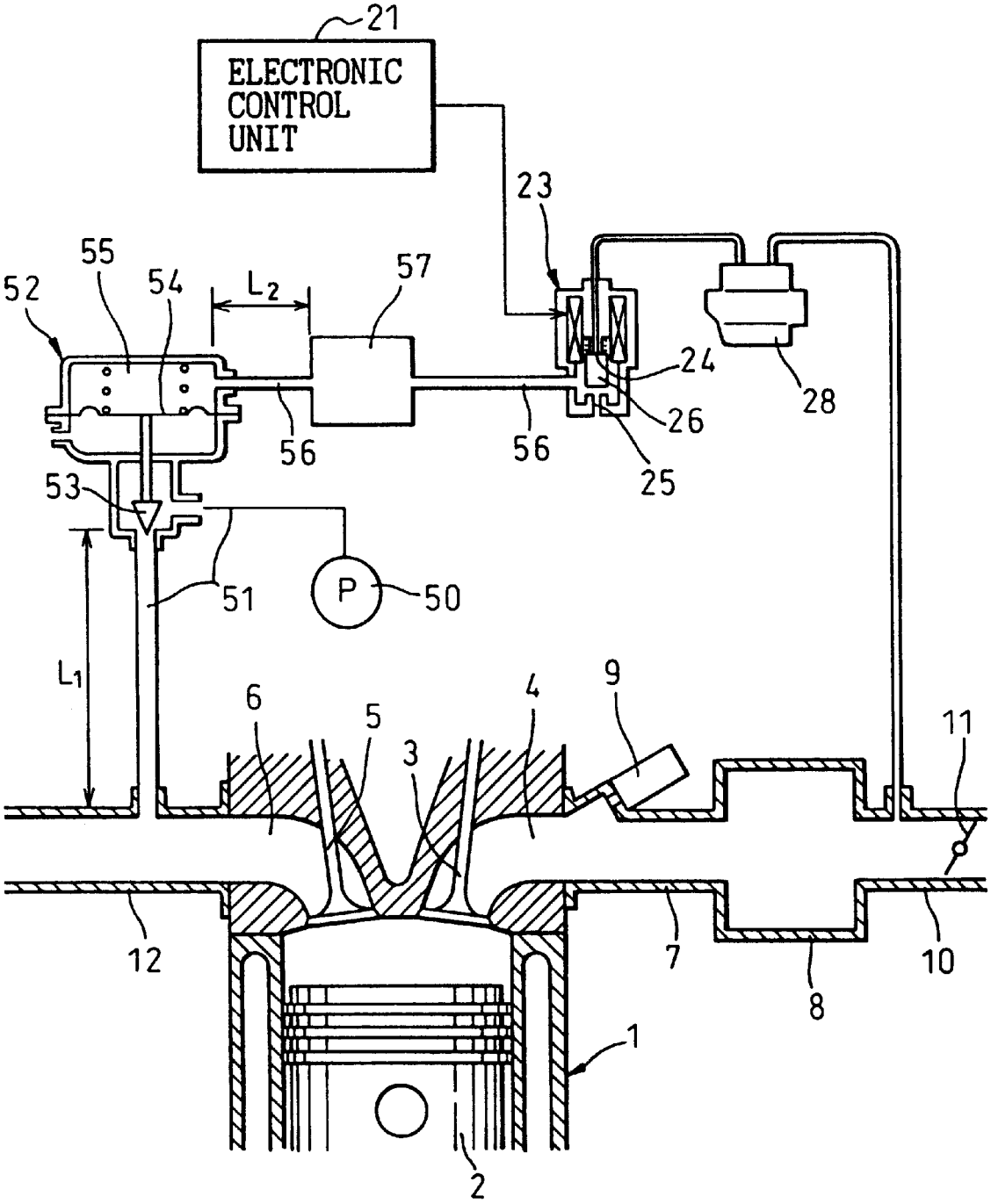
FIG. 11 is an overall view of an internal combustion engine showing still another embodiment.

FIG. 11 shows the case of application of the present invention to a secondary air feed device. Referring to FIG. 11, in this embodiment, for example, an air discharge port of a motorized air pump 50 is connected through a secondary air feed conduit 51 to the exhaust manifold 12. A gas flow control valve, that is, a secondary air feed control valve 52, is disposed in the secondary air feed conduit 51. This secondary air feed control valve 52 is comprised of a valve body 53, a diaphragm 54, and a pressure control chamber 55. The pressure control chamber 55 is connected through a conduit 56 to the pressure control valve 23. The pressure control valve 23 is controlled by the duty ratio. The amount of secondary air supplied in the exhaust manifold 12 is controlled by this.

A volume chamber 57 is disposed in the conduit 56 and the length L2 between the secondary air feed control valve 52 and the volume chamber 57 is made ¼ of the length L1 between the exhaust manifold 12 and the valve body 53. Therefore, in this embodiment as well, like with the EGR control valve 14 shown in FIG. 1, it is possible to suppress the vibration of the valve body 53 and the diaphragm 54.

Figure 12:
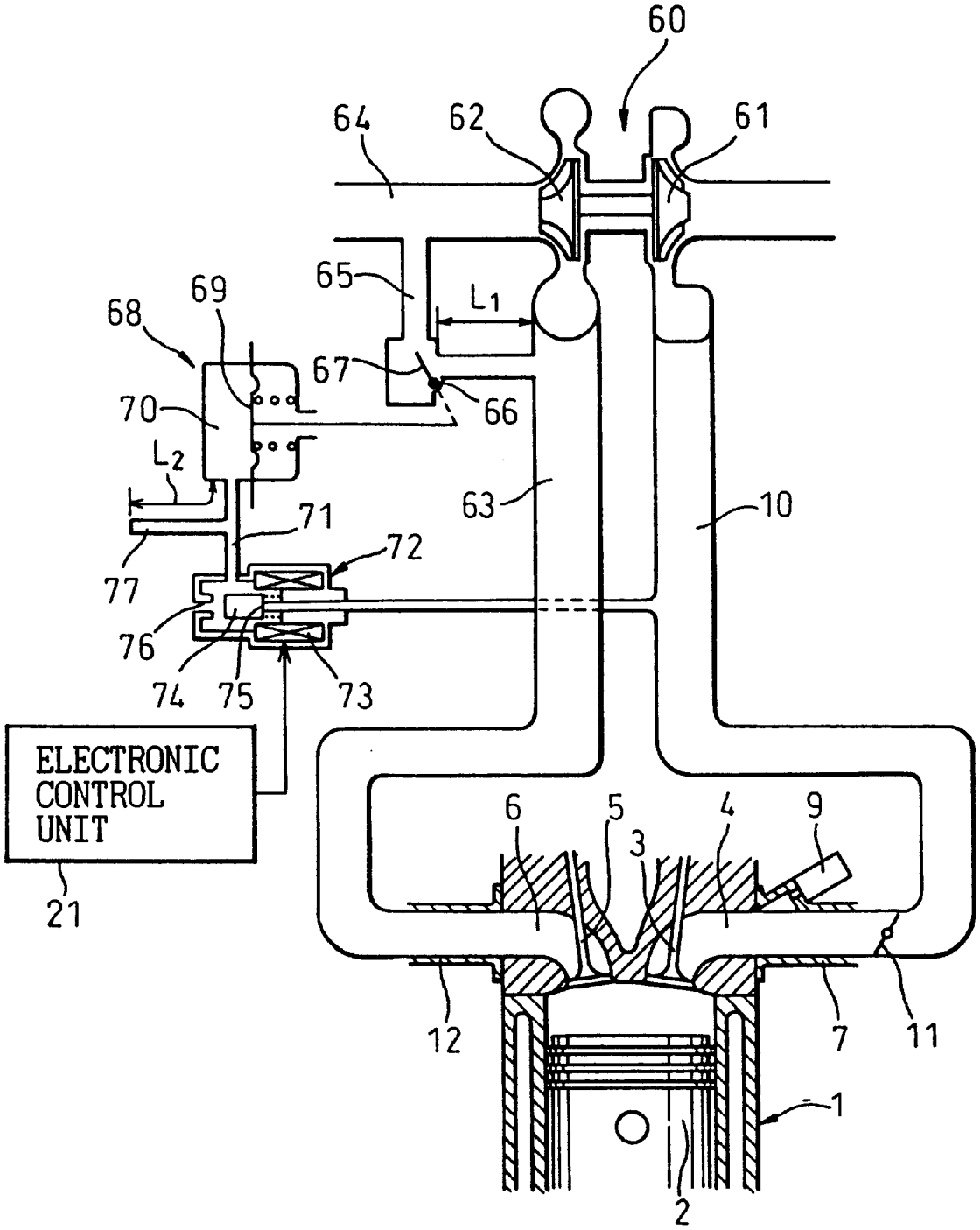
FIG. 12 is an overall view of an internal combustion engine showing still another embodiment.

FIG. 12 shows the case of the application of the present invention to a supercharging pressure control valve. Referring to FIG. 12, reference numeral 60 shows an exhaust turbocharger comprised of a compressor 61 and an exhaust turbine 62. An exhaust pipe 63 and an exhaust flow pipe 64 are connected through a bypass passage 65. In this bypass passage 65 is disposed a waist gate valve 67 able to rotate about a pivot shaft 66. This waist gate valve 67 is connected to an actuator 68. The actuator 68 is provided with a diaphragm 69 connected to the waist gate valve 67 and a pressure control chamber 70. The pressure control chamber 70 is connected to a pressure control valve 72. The pressure control valve 72 is provided with a valve body 74 controlled in attraction by a solenoid 73, a supercharging pressure port 75 connected to the intake duct 10, and an atmospheric pressure port 76.

The pressure control valve 72 is controlled in duty ratio. The positive pressure in the pressure control chamber 70, that is, the opening of the waist gate valve 67, is controlled by this. In this embodiment, a tube 77 is branched from the conduit 71 and the length L2 from the actuator 68 to the closed end of the tube 77 is made equal to the length L1 from the exhaust pipe 63 to the waist gate valve 67. In this embodiment, when a positive pressure wave acts on the waist gate valve 67, a negative pressure occurs in the pressure control chamber 70 and the negative pressure wave resulting from this negative pressure reflects back at the open end of the tube 77 and then is propagated toward the pressure control chamber 70. That is, in this embodiment, when a positive pressure wave acts on the waist gate valve 67, a negative pressure wave acts in the pressure control chamber 70, so it is possible to prevent the vibration of the diaphragm 69.

According to the present invention, as mentioned above, it is possible to prevent the amplitude of the vibration of the movable member of a gas flow control valve from being too large at the time of a specific operating state.

While the invention has been described by reference to specific embodiments chosen for purposes of illustration, it should be apparent that numerous modifications could be made thereto by those skilled in the art without departing from the basic concept and scope of the invention.

We claim:

1. A flow control device for an engine having an exhaust passage, comprising:

a gas flow passage connected to the exhaust passage;

a gas flow control valve having a valve body, a movable member connected to the valve body, and a pressure control chamber defined by the movable member, the valve body being arranged in the gas flow passage;

a pressure control valve connected to the pressure control chamber via a fluid conduit for controlling an absolute pressure in the pressure control chamber to control an amount of displacement of the movable member, an amplitude of vibrations of the valve body and the movable member being increased due to vibration of an air column, which is generated in the gas flow passage when the engine is operating in a particular operating state determined by the engine; and a volume chamber arranged in the fluid conduit between the pressure control chamber and the pressure control valve for suppressing the vibration of the movable member by using a reflecting wave of a pressure wave which has been generated in the pressure control chamber by the vibration of the movable member when the engine is operating in the particular operating state, the volume chamber being directly connected to the pressure control chamber by a valve-less passage to prevent attenuation of the pressure wave generated in the pressure control chamber.

2. A flow control device as set forth in claim 1, wherein the pressure control valve controls the absolute pressure in the pressure control chamber by repeated opening and closing.

3. A flow control device as set forth in claim 2, wherein a length of the gas flow passage and a length of the fluid conduit are determined so that, when a positive pressure wave acts on the valve body due to vibration of the air column, the positive pressure wave which reflects back to the volume chamber acts in the pressure control chamber.

4. A flow control device as set forth in claim 3, wherein the length of the gas flow passage is the same as the length of the fluid conduit.

5. A flow control device as set forth in claim 3, wherein the length of the gas flow passage is an even integer multiple of the length of the fluid conduit.

6. A flow control device as set forth in claim 3, wherein the length of the gas flow passage is an integer multiple of the length of the fluid conduit.

7. A flow control device as set forth in claim 1, wherein the gas flow passage is an exhaust gas recirculation passage.

8. A flow control device as set forth in claim 1, wherein the movable member is a diaphragm.

9. A flow control device for an engine having an exhaust passage, comprising:

a gas flow passage connected to the exhaust passage;

a gas flow control valve having a valve body, a movable member connected to the valve body, and a pressure control chamber defined by the movable member, the valve body being arranged in the gas flow passage;

a pressure control valve connected to the pressure control chamber via a fluid conduit for controlling an absolute pressure in the pressure control chamber to control an amount of displacement of the movable member, an amplitude of vibrations of the valve body and the movable member being increased due to vibration of an air column, which is generated in the gas flow passage when the engine is operating in a particular operating state determined by the engine;

vibration suppressing means arranged in the fluid conduit for suppressing the vibration of the movable member by using a reflecting wave of a pressure wave which has been generated in the pressure control chamber by the vibration of the movable member when the engine is operating in the particular operating state; and prohibiting means for prohibiting the action of the suppression of the vibration of the movable member by the vibration suppression means other than in a specific operating state.

10. A flow control device as set forth in claim 9, wherein the vibration suppressing means is comprised of a tube branched off from the fluid conduit and connected to a volume chamber and the prohibiting means is comprised of a switching valve which is disposed in the tube and which is closed except in the specific operating state.

11. A flow control device as set forth in claim 9, wherein the vibration suppressing means is comprised of a tube branched off from the fluid conduit and having a closed end and said prohibiting means is comprised of a switching valve which is disposed in the tube and which is closed except in the specific operating state.

12. A flow control device as set forth in claim 9, wherein the specific operating state is when the engine speed is in a predetermined range.

13. A flow control device as set forth in claim 12, wherein the gas flow passage is an exhaust gas recirculation passage and the specific operating state is when the operating region is one where the exhaust gas should be recirculated and the engine speed is in a predetermined range.

* * * * *